United States Patent [19]

Weiss

[11] Patent Number: 4,511,340

[45] Date of Patent: Apr. 16, 1985

[54] METHOD OF FORMING HOT CATHODES

[75] Inventor: Eberhard Weiss, Stuttgart, Fed. Rep. of Germany

[73] Assignee: International Standard Electric Corporation, New York, N.Y.

[21] Appl. No.: 451,567

[22] Filed: Dec. 20, 1982

[30] Foreign Application Priority Data

Dec. 24, 1981 [DE] Fed. Rep. of Germany ..... 3151347

[51] Int. Cl.[3] ..... H01J 9/04

[52] U.S. Cl. ..... 445/6

[58] Field of Search ..... 445/5, 6

[56] References Cited

U.S. PATENT DOCUMENTS 3,357,766 12/1967 Conger, Jr. ..... 445/6
3,441,333 4/1969 Javorik ..... 445/6 X
4,125,306 11/1978 Coble ..... 445/6 X
4,326,762 4/1982 Hocken ..... 445/5

*Primary Examiner*—Kenneth J. Ramsey
*Attorney, Agent, or Firm*—James B. Raden; Edward J. Brosius

[57] ABSTRACT

A method is disclosed which permits instant-heat cathodes for color-picture tubes to be formed in a single process step and avoids the formation of an activated barium-oxide deposit on the grid cylinder. This is achieved by alternately switching the heater current on and off with the operating voltages applied, the heater voltage and the "on" and "off" periods of the heater current being chosen so that, averaged over the "on" and "off" periods, the rated heating power and the rated power dissipation are maintained during the formation process, and that, when the temperature of the emitting material decreases during the "off" periods, no saturation of the electrode currents occurs.

2 Claims, No Drawings

METHOD OF FORMING HOT CATHODES

The present invention relates to a method of forming hot cathodes coated with an emitting material, comprising heating the cathode sleeve to about 1,200° C. as rapidly as possible and then repeatedly switching the heater current on and off to provide a maximum temperature difference between the sleeve and the deposited emitting material.

Such a method of forming cathodes for indirectly heated amplifier tubes is disclosed in German Pat. No. 1,205,628, published Nov. 25, 1965. There the heater current is switched on and off from about one hundred to several hundred times, with no operating voltage applied to the other electrodes of the tube. The indirectly heated cathodes of the amplifier tubes consist of a sleeve made of so-called cathode nickel and containing a coil-shaped heater covered with an insulating layer, the outer surface of the sleeve is coated with the emitting material. The sleeve is held at its two ends in holes of mica disks. The holes are so narrow that a press fit is obtained after the sleeve has been pressed in. As a result of the alternate warm-up and turn-off, a snug fit is obtained for the normal operating temperature, so that heat dissipation is reduced from that during the press fit; consequently, a more uniform temperature distribution over the entire length of the cathode and an accumulation of free barium in the emitting material are achieved. This process is followed by the so-called burn-in at about the normal operating temperature of the cathode and with the electrode voltages applied, i.e., under current load conditions.

The cathode-forming method described in German Pat. No. 1,205,628 cannot be used under current load conditions because, if the sleeve were cooled down to 300° C., not only a saturation effect of the electrode currents but even an island-shaped, nonuniform emission from the emitting surfaces would occur, which would damage the emissive coating.

The object of the present invention is to provide a method of forming instant-heat cathodes for television-picture tubes in a single process step and under load conditions. The invention is characterized in that the rated voltages are applied to the electrodes of the electron-gun system, that the heater voltage and the "on" and "off" periods of the heater current are so chosen that, averaged over the "on" and "off" periods, the rated heating power and the rated power dissipation are maintained during the formation process, and that, when the temperature of the emitting material decreases during the "off" periods, no saturation of the electrode currents occurs.

The invention will now be described in detail. During the formation of cathodes for television-picture tubes by the prior art method, barium inevitably evaporates from the emitting material deposited on the cathode cap closing one end of the sleeve, and deposits as barium oxide on the adjacent grid cylinder. If the grid cylinder, which is made of a chromium-nickel alloy, becomes too hot, activating substances such as Si, Mn, C, Al, which are present as trace elements in this material in sufficient quantities, will diffuse into and activate the vapor-deposited barium coating, thus producing a very tenacious emissive coating which causes afterglow. It is therefore desirable to operate at temperatures at which such unavoidable barium evaporation is greatly reduced. If the temperature of the grid cylinder is then kept correspondingly low, the reduced barium-oxide deposit on the grid cylinder will no longer be activated. In other words, the activating process should be such that, while the barium oxide in the emissive coating deposited on the cathode cap is activated by diffusion of activating substances from the cap material into this coating, as little barium as possible evaporates, deposits on the grid cylinder, and is activated there. This is achieved by arranging that, on an average, the activating process takes place at the normal operating temperature of the tube. The "on" and "off" periods of the heater current are so chosen that, on an average, the rated heater power is consumed. Since present-day television-picture tubes use only so-called instant-heat cathodes, i.e., cathodes whose warm-up time is shortened by a reduction in thermal capacity, and since this development is still in progress, no generally valid statements can be made on the "on" and "off" periods. These values have to be determined for each cathode design separately. Advantageously, the time the underside of the cap needs to cool from about 1,200° C. to 500°–400° C. is taken as a basis. This temperature of 500°–400° C. suffices to ensure that no saturation occurs. This time determines the heater voltage and the "on" period, during which the underside of the cap must be heated from 500°–400° C. to about 1,200° C. While the cooling time is given by the thermal capacity of the cathode and the heat dissipation of the system, the "on" period can be influenced by suitable choice of the magnitude of the heater voltage within the load limits of the filament. The "on" and "off" periods of the heater current should be kept as short as possible in order to reduce formation times to a minimum. It should be pointed out once again that throughout the formation time, the rated voltages are applied to the other electrodes of the electron-gun system.

The cathode-forming method according to the invention avoids any afterglow caused by an activated barium-oxide deposit on the grid cylinder and shortens the formation process.

I claim:

1. A method of forming cathodes for use in a cathode ray tube comprising the steps of:

supplying current to the heater tube element to rapidly heat the cathode sleeve to about 1200° C., switching the heater current on and off repeatedly to provide a temperature differential between the cathode and the emitting material deposited thereon, applying rated voltages to the electrodes in the cathode ray tube, cycling the heater current between on and off such that the current average maintains the rated heating power and power dissipation with the off periods regulated such that when the temperature of the emitting material decreases, no saturation of the electrode current occurs.

2. The method of claim 1, wherein the cathode sleeve is allowed to cool to 400°–500° C. during said heater current off periods.

* * * * *